United States Patent [19]

de Graaf

[11] Patent Number: 4,569,508

[45] Date of Patent: Feb. 11, 1986

[54] METALLURGICAL VESSEL HAVING AN OPENING AND A FLANGE AROUND THE OPENING

[75] Inventor: Jan A. de Graaf, Heemskerk, Netherlands

[73] Assignee: Hoogovens Groep B.V., Ijmuiden, Netherlands

[21] Appl. No.: 664,096

[22] Filed: Oct. 24, 1984

Related U.S. Application Data

[63] Continuation of Ser. No. 494,878, May 16, 1983, abandoned.

[30] Foreign Application Priority Data

May 26, 1982 [NL] Netherlands ..... 8202140

[51] Int. Cl.[4] ..... C21C 5/46

[52] U.S. Cl. ..... 266/275; 266/285; 266/903; 432/251

[58] Field of Search ..... 266/275, 243, 282, 242, 266/274, 276, 903, 285; 432/250, 251, 262–265, 252

[56] References Cited

U.S. PATENT DOCUMENTS

| | | | |
|---|---|---|---|
| 2,089,026 | 8/1937 | Hoffman | 432/251 |
| 2,526,687 | 10/1950 | Reams | 266/275 |
| 3,695,602 | 10/1972 | Mevissen | 266/903 |
| 3,735,010 | 5/1973 | Turpin | 266/242 |
| 3,879,167 | 4/1975 | De Luca | 266/274 |
| 4,047,708 | 9/1977 | Lee et al. | 266/243 |
| 4,059,397 | 11/1977 | Adler | 432/251 |
| 4,083,752 | 4/1978 | Bielski et al. | 432/251 |

*Primary Examiner*—L. Dewayne Rutledge
*Assistant Examiner*—S. Kastler
*Attorney, Agent, or Firm*—Stevens, Davis, Miller & Mosher

[57] ABSTRACT

A metallurgical vessel having a bottom, a side wall structure defining an opening remote from the bottom, a refractory lining for the interior of the vessel and a unitary metal flange fixed to the vessel and extending around the opening and over the lining, and having an inner periphery directed towards the opening and an outer periphery wherein in order to reduce thermal stresses in the flange there are a plurality of holes in the flange metal spaced from the inner periphery and extending over the refractory lining and distributed circumferentially around the flange whereby heat flow through the flange from its inner periphery to its outer periphery is restricted.

5 Claims, 8 Drawing Figures

METALLURGICAL VESSEL HAVING AN OPENING AND A FLANGE AROUND THE OPENING

This application is a continuation of application Ser. No. 494,878, filed May 16, 1983, now abandoned.

BACKGROUND OF THE INVENTION

1. Field of the Invention

This invention relates to a metallurgical vessel having an opening and a supporting and/or protecting flange extending around said opening.

Although the invention is applicable to all types of metallurgical installations, it will be described below, mainly in relation to installations in the steel industry, namely particularly in relation to a converter vessel for the manufacture of steel, and to a tundish for the continuous casting of steel.

2. Description of the Prior Art

A converter vessel for steel manufacture is provided with a circular flange which delimits the open mouth of the converter vessel. The vessel is lined with refractory material on its inside. The flange serves to give the converter vessel dimensional stability and to close the refractory lining at the top. A replaceable top ring, in the form of a further circular flange, is often fitted to this flange of the converter vessel, in order to protect the flange of the converter vessel from mechanical forces which arise in use e.g. during the loading of the converter with scrap, or during the scraping off of deposits. This further flange also covers and protects any exposed top surface of the refractory lining. The invention can be applied to such a top ring (or further flange) as well as to the main flange of the converter. Such structures are known to experts in this field and do not require detailed explanation.

In these flange structures, the following problems tend to occur separately and in combination:

(a) The flange of the converter vessel is deformed and shrinks during operation. In the course of time, shrinkage of 60 mm in the diameter i.e. about 1.5% has been observed; shrinkage is an ever continuing phenomenon.

(b) In the course of a campaign, the top ring begins to distort and some parts of this top ring which consists of several different parts, are lost during the campaign particularly at the location where scrap and pig iron are charged into the converter.

(c) After each campaign new parts of the top ring must be fitted to the converter.

(d) The new top ring parts must be adapted to the main flange because of the deformation and shrinkage of the main flange of the converter vessel.

(e) The repair of the top ring after each campaign involves high maintenance costs.

In the continuous casting of slabs, liquid steel is admitted to a tundish, from which the steel exits as for example two cast strands. The tundish is provided with a rectangular flange which forms the upper face of the tank which is lined inside with refractory material. The flange serves to close the refractory lining, to protect it and to retain the shape of the tank. Such a tundish is known to the experts in this field and needs no further explanation. One problem with the tundish is that the flange is sometimes deformed and/or cracked when the tundish is heated or when the tundish is used for the continuous casting of steel. Frequent repair of the flange leads to high maintenance costs.

FR-A-2085362 recognises the problem of heat stress in the flange of a converter and describes attempts to solve it by circulation of coolant. Clearly this is an elaborate and expensive measure.

SUMMARY OF THE INVENTION

The object of the invention is to provide an improved structure of the flange of a metallurgical vessel, particularly a steel converter or a tundish, so that the flange is less susceptible to deformation or cracking due to heat stress or mechanical damage, and consequently has a longer life and is subject to lower maintenance costs.

The invention is based on the realisation that the problems described above are the result of non-uniform temperature of the flange due to hot gases and radiant heat escaping from the flange opening. These cause the flange to become very hot at its inner face, whilst the temperature of the outer face of the flange is determined more by ambient temperature. As the flange becomes warmer the flange material tends to undergo plastic flow close to the inner face, and as the flange cools down material tends to flow undergo plastic close to the outer face.

According to the invention the flange, which experiences a temperature difference over its width due to an increased temperature in the metallurgical installation has a number of removed portions of flange metal distributed round its circumference and located at or close to the inner face of the flange. Such removed portions can be arranged appropriately in order to reduce the thermal stresses in the flange and/or prevent or reduce permanent deformations of the flange and/or cracks in the flange.

By "removed portions" is meant locations where the continuous structure of the flange is interrupted, e.g. by holes or slots. In making such removed portions, usually metal is removed but the removed portions may alternatively be created during making of the flange.

One preferred form of the removed portions is holes spaced from the inner periphery of the flange so as to reduce the heat flow through the flange, from the inside to the outside, as a result of the temperature difference over the flange width. Thus the flange, viewed from inside to the outside, has, at locations past the holes, a lower temperature than would be the case if the holes were absent. Another preferred form of the removed portions is slots extending from the inner face, preferably at right angles to the inner face, over part of the flange width. In some cases a combination of these holes and these slots is suitable, with the slots provided between adjacent pairs of holes in the flange. By these measures it is possible to reduce or prevent deformation and cracking of the flange, and achieve a long flange life and reduced maintenance costs.

In the case of the holes, these should preferably occupy a total of at least 25% of the circumferential length of the flange; they should also preferably have a slot shape with their direction of elongation in the circumferential direction.

To prevent contamination by dirt the holes should preferably be closed at at least one of the upper and lower surfaces of the flange, e.g. by means of plates fitted in the holes close to the upper or lower surface. In this case the holes should preferably be filled with a refractory thermal insulation material for a further reduction of the temperature of the flange past the holes, viewed from inside to the outside.

For further restriction of permanent deformation of the flange, material should preferably be removed from the inner face of the flange, near the holes, so that a relatively flexible beam is left between each hole and the inner face.

In the case of the slots, these should preferably extend over at least 25% of the flange width (from inner to outer periphery).

Again, to prevent contamination, the slot should preferably be closed near to at least one of the upper and lower surfaces of the flange, e.g. by a light weld.

Where there is a combination of the holes and the slots, the slots should preferably extend beyond the holes, viewed from the inner face of the flange.

The invention also provides a vessel having a flange as described above and further having, attached thereto, a detachable additional flange which is provided with removed portions as proposed by the invention.

BRIEF DESCRIPTION OF THE DRAWINGS

Preferred embodiments of the invention will now be described by way of non-limitative example with reference to the accompanying drawings, in which.

DESCRIPTION OF THE PREFERRED EMBODIMENTS

Figure 1:
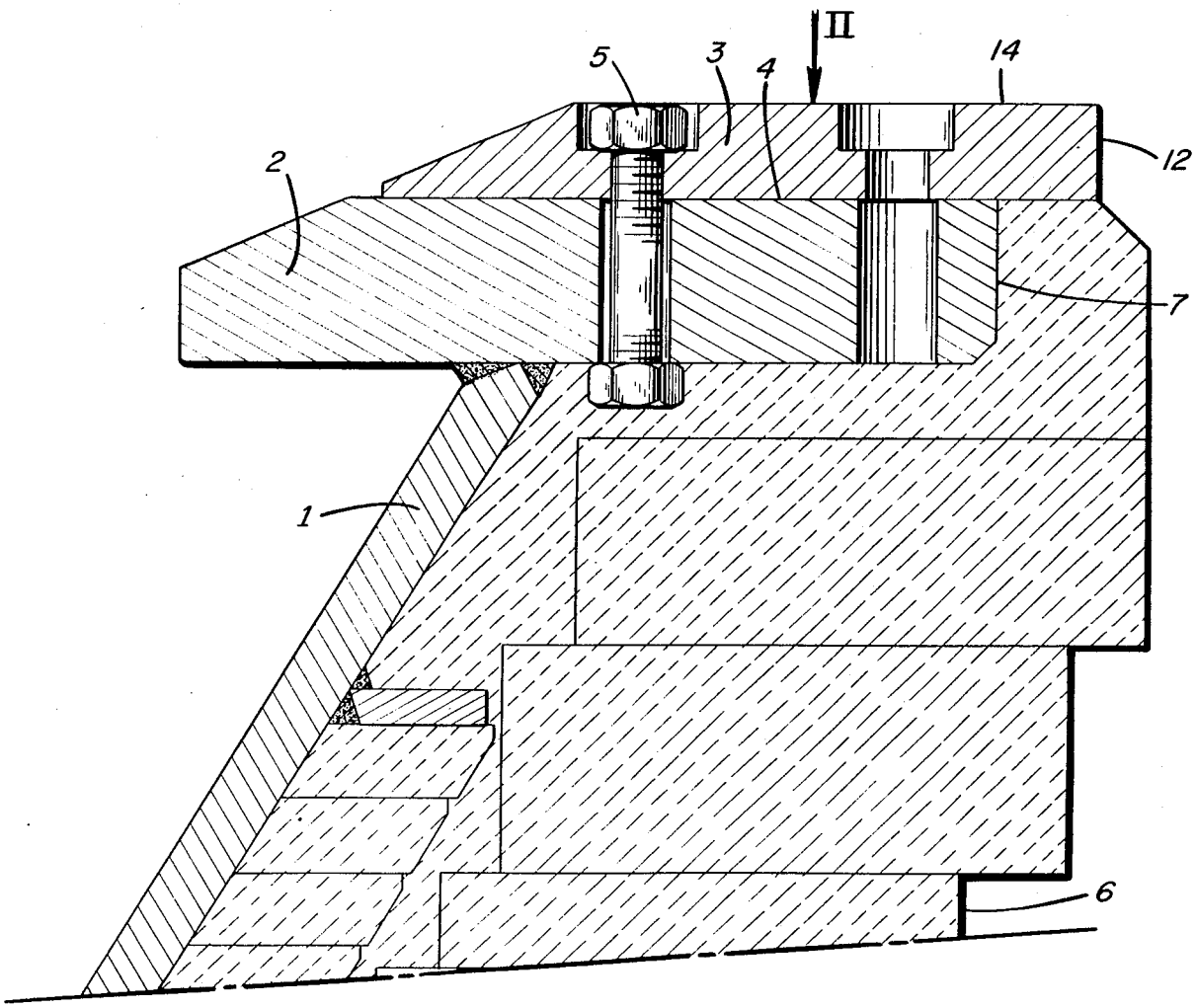
FIG. 1 is a vertical section along line I—I in FIG. 2 of the top portion of a steel converter vessel embodying the invention.

FIG. 1 shows the shell 1 of the converter vessel whose open top is bounded by a main flange 2. The converter vessel is provided on the inside with a refractory lining 6. A top ring 3 is detachably secured by bolts 5 on the upper surface 4 of the flange 2 to close the lining and to protect the flange 2. In use of this converter vessel, steel is manufactured from pig iron and scrap iron. Such a vessel is known to the expert and requires no further explanation.

The problems of deformation of the flange 2 and top ring 3 already mentioned, and of the limited life of the top ring, may have many causes. However, the present applicant has based the measures described below on the realisation that the problems are caused by the uneven (non-uniform) temperature of the flange and top ring due to the hot gases escaping through the converter opening and released during the steel making process and due to radiant heat.

Figure 2:
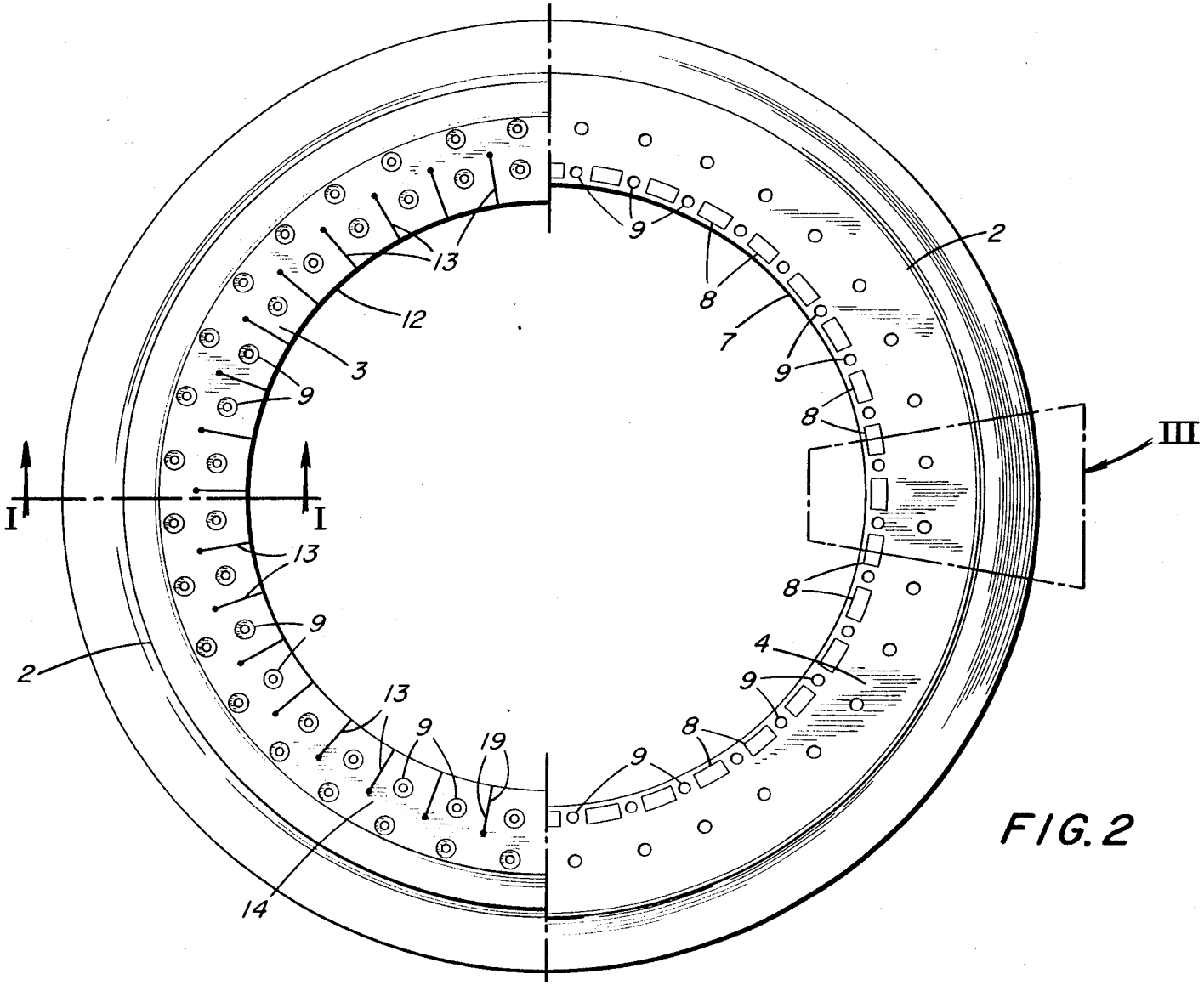
FIG. 2 is a top plan view of the converter opening, shown at the left with a top ring and at the right without the top ring, in the direction of the arrow II in FIG. 1.

FIGS. 2 (right hand side) 3 and 4 show the measures taken with regard to the flange, in which a number of holes 8, extending through the flange at right angles to the upper and lower surfaces of the flange and distributed circumferentially around the flange are provided in flange 2 close to inner face 7. These holes form a barrier for the flow of heat from the inside to the outside of the flange, thereby causing the flange, viewed from inside to the outside, to have a lower temperature past the holes 8 than a flange without such holes, and preventing or reducing the flowing of the flange with the resultant shrinkage.

Figure 3:
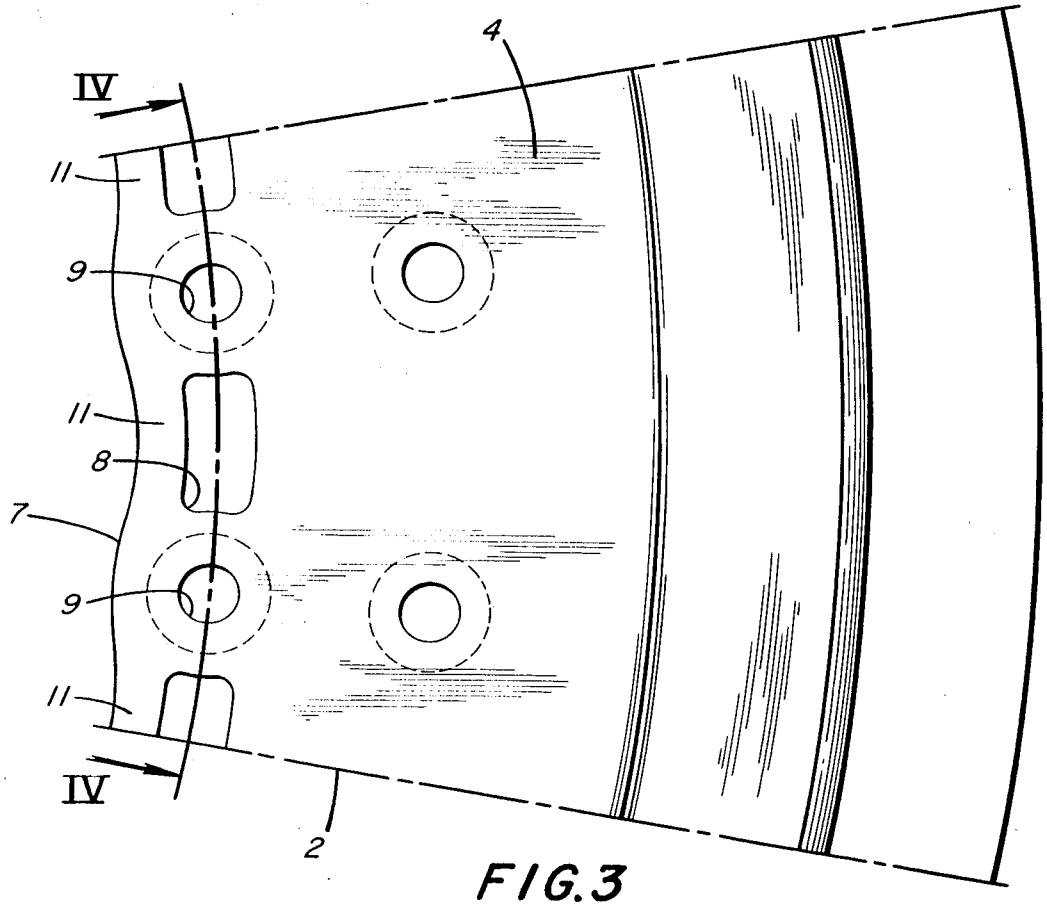
FIG. 3 shows a detail of the flange of FIGS. 1 and 2, at III in FIG. 2.
Figure 4:
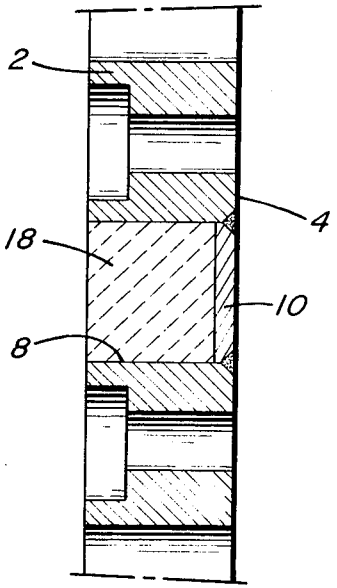
FIG. 4 is a vertical section of the flange along line IV—IV of FIG. 3.

The holes 8, excluding any intervening bolt holes 9, have a total circumferential length which is at least 25% of the circumference of their pitch circle, i.e. the circle on which they are located. The holes 8, as shown in FIGS. 2 and 3 have a slot shape extending in the circumferential direction. As shown in FIG. 4, the holes 8 are sealed by a small plate 10, or similar sealing element, secured by welding, for example, at the level of the upper surface 4 of the flange 2. The holes are filled with a refractory thermal insulating compound 18.

FIG. 3 also shows the feature (not apparent in FIG. 2) that material is removed from the inner face 7 of the flange 2 close to the holes 8, so that a relatively flexible beam 11 is left between each hole 8 and the inner face 7.

FIG. 2 (left-hand side) shows the measures taken with regard to the top ring 3. The top ring 3 is provided at points spaced round the circumference with slots 13 extending radially from the inner face 12. This prevents or restricts deformation of the top ring under thermal loading. The length of the slots 13 is at least 25% of the width of the top ring 3 from the inner face 12 to its outer periphery. To prevent the penetration of dirt into the slots 13, resulting in the loss of the mobility of the flange material provided by the slots, the slots are closed by welding securely at the upper surface 14 and the inner surface 12 of the top ring 3, by a light weld at locations 19.

These measures taken with regard to the top ring 3 advantageously enable the top ring to be made in one-piece.

Figure 5:
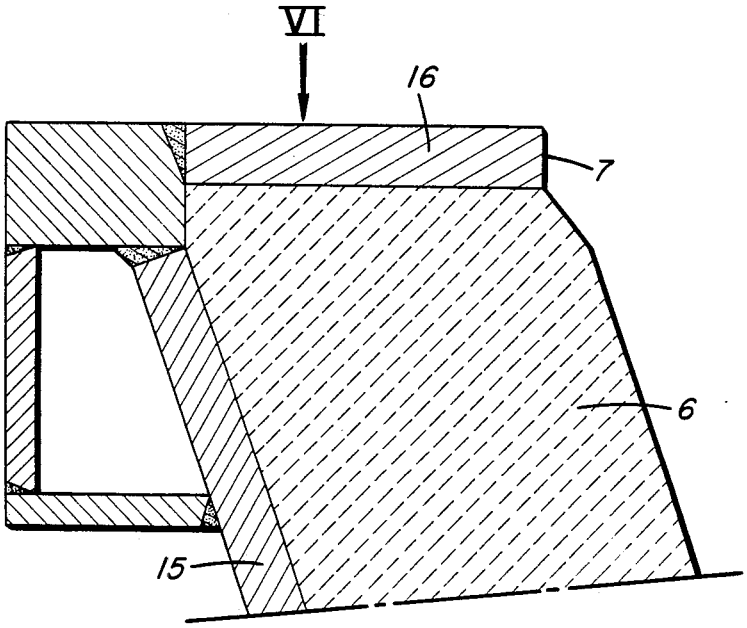
FIG. 5 is a vertical section along line V—V of FIG. 6 of the top of a tundish embodying the invention.

FIG. 5 shows a tundish 15 whose open top is bounded by a rectangular flange 16. The tundish is provided on its inside with a refractory lining 6. The tundish is stiffened and the refractory lining is protected by the flange 16. In the continuous casting of sheets, liquid steel is poured into the tundish from which the steel is fed to for example two casting strands. Such a tundish is known to the expert in this field, and requires no further explanation. The problem of deformation and/or cracking of the flange, already mentioned, may be due to a number of factors. However, the applicant has based the measures described below on the realisation that the problem is caused by uneven (non-uniform) temperature of the flange due to hot gases escaping through the flange opening when the tundish is in use, and due to radiant heat.

Figure 6:
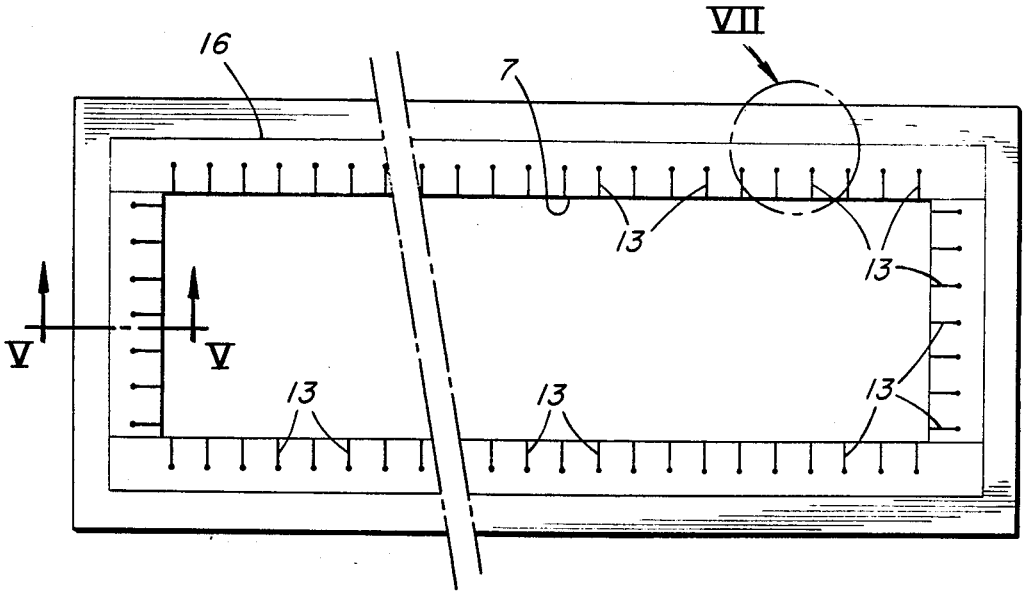
FIG. 6 is a top plan view of the tundish in the direction of arrow VI in FIG. 5.
Figure 7:
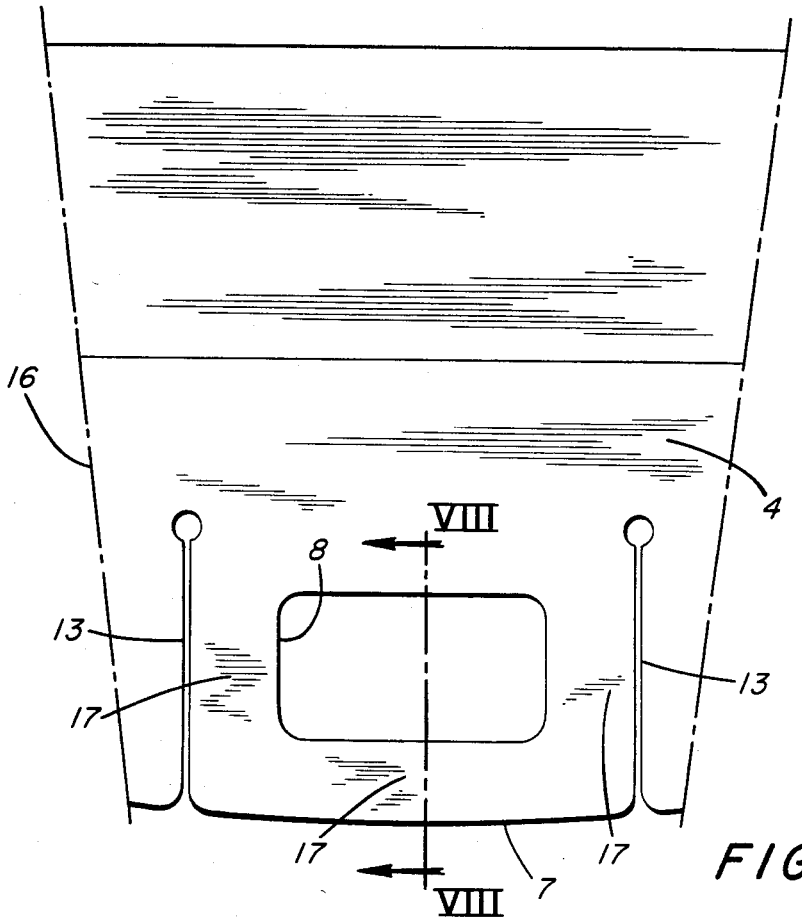
FIG. 7 shows a detail of the flange of FIGS. 5 and 6, at VII in FIG. 6.
Figure 8:
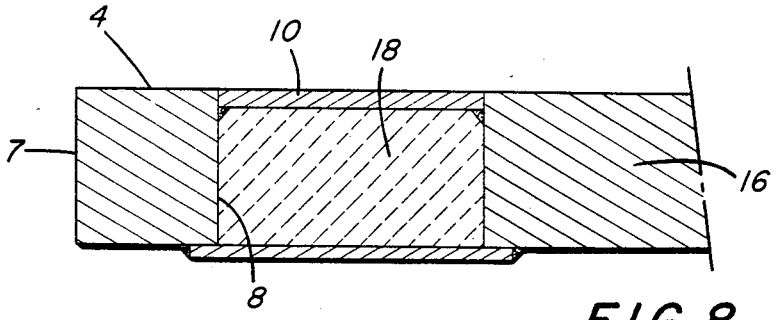
FIG. 8 is a vertical section of the flange on line VIII—VIII of FIG. 7.

FIGS. 6,7 and 8 show the flange 16 is provided close to its inner face 7 with a number of holes 8 distributed round the circumference of the flange and extending through the thickness of the flange, and between each pair of holes 8, with a slot 13 which extends at right angles to the face 7 over part of the flange width, viewed from inner surface 7, to beyond the outer side of the holes 8. The combination of holes 8 and slots 13 provides a highly effective solution, preventing or reducing deformation of flange 16. This is due to (a) the lower temperature of the flange past holes 8 as viewed from inner face 7, (b) the prevention or reduction of thermal stresses in the circumferential direction of the flange 16 by means of slots 13, and (c) the flexible U-shape of the hot part 17 of the flange, located close to inner face 7 and between a hole 8 on the one hand and two slots 13 and the inner face 7 on the other.

The holes 8 of the flange 16 are slot-shaped and are each sealed close to upper surface 4 by a plate 10. The holes are also filled with a refractory thermal insulating compound 18.

Many variations falling within the scope of the invention are possible e.g. for the arrangement of holes 8 and slots 13, e.g. the number of the holes and slots and their mutual positions and sizes.

What is claimed is:

1. A metallurgical vessel having a bottom, a side wall structure defining an opening remote from the bottom, a refractory lining for the interior of said vessel and a unitary metal flange fixed to said vessel and extending around said opening and over said lining, and having an inner periphery directed towards said opening and an outer periphery wherein in order to reduce thermal stresses in said flange there are a plurality of holes in the flange metal spaced from the inner periphery and extending over the refractory lining and distributed circumferentially around the flange whereby heat flow through the flange from its inner periphery to its outer periphery is restricted, said holes are closed adjacent at least one of the upper and the lower surfaces of the flange by plates secured in the holes.

2. A vessel according to claim 1 wherein, in addition to said plates, the holes are filled with a refractory thermally insulating material.

3. A metallurgical vessel having a bottom, a side wall structure defining an opening remote from the bottom, a refractory lining for the interior of said vessel and a unitary metal flange fixed to said vessel and extending around said opening and over said lining, and having an inner periphery directed towards said opening and an outer periphery wherein in order to reduce thermal stresses in said flange there are a plurality of holes in the flange metal spaced from the inner periphery and extending over the refractory lining and distributed circumferentially around the flange whereby heat flow through the flange from its inner periphery to its outer periphery is restricted, said flange defining slots extending from the inner periphery of the flange over part of the flange width, said slots being closed, by welding, adjacent at least one of the upper and lower surfaces of the flange.

4. A metallurgical vessel having a bottom, a side wall structure defining an opening remote from the bottom, a refractory lining for the interior of said vessel and a unitary metal flange fixed to said vessel and extending around said opening and over said lining, and having an inner periphery directed towards said opening and an outer periphery wherein in order to reduce thermal stresses in said flange there are a plurality of holes in the flange metal spaced from the inner periphery and extending over the refractory lining and distributed circumferentially around the flange whereby heat flow through the flange from its inner periphery to its outer periphery is restricted, said flange having a slot between each adjacent pair of said holes, said slot extending from the inner periphery of the flange over part of the flange width, each said slot being closed, by welding, adjacent one of the upper and lower surfaces of the flange.

5. A metallurgical vessel having a bottom, a side wall structure defining an opening remote from the bottom, a refractory lining for the interior of said vessel and a unitary metal flange fixed to said vessel and extending around said opening and over said lining, and having an inner periphery directed towards said opening and an outer periphery wherein in order to reduce thermal stresses in said flange there are a plurality of holes in the flange metal spaced from the inner periphery and extending over the refractory lining and distributed circumferentially around the flange whereby heat flow through the flange from its inner periphery to its outer periphery is restricted, said flange having slots extending from the inner periphery of the flange over part of the flange width, said slots being closed, by welding, adjacent at least one of the upper and lower surfaces of the flange, said slots extending over at least 25% of the flange width.

* * * * *